US006004098A

United States Patent [19]

Chevallier et al.

[11] Patent Number: 6,004,098

[45] Date of Patent: Dec. 21, 1999

[54] PROPULSION UNIT FOR AN AIRCRAFT AND ITS CONTROL PROCEDURE

[75] Inventors: Marc Chevallier, Paris; Jean-Philippe Mercier, Levallois-Perret, both of France

[73] Assignee: Renault Sport, Viry Chatillon, France

[21] Appl. No.: 08/943,521

[22] Filed: Oct. 3, 1997

[30] Foreign Application Priority Data

Oct. 4, 1996 [FR] France ..... 96 12110

[51] Int. Cl.[6] ..... B63H 3/10

[52] U.S. Cl. ..... 416/30; 416/27; 416/28; 416/29; 416/36; 416/37; 416/38; 416/47; 416/48; 416/157 R

[58] Field of Search ..... 416/27, 28, 29, 416/30, 36, 37, 38, 47, 48, 157 R

[56] References Cited

U.S. PATENT DOCUMENTS

| | | | |
|---|---|---|---|
| 2,901,885 | 9/1959 | Reggio . | |
| 4,449,370 | 5/1984 | Ream . | |
| 4,626,170 | 12/1986 | Dorsch | 416/29 |
| 4,693,670 | 9/1987 | Hawener et al. . | |
| 4,934,825 | 6/1990 | Martin . | |
| 4,958,289 | 9/1990 | Sum et al. | 364/431.01 |
| 5,083,544 | 1/1992 | Brighigna . | |
| 5,209,640 | 5/1993 | Moriya | 416/27 |
| 5,315,819 | 5/1994 | Page et al. | 60/39.282 |
| 5,363,652 | 11/1994 | Tanaka et al. | 60/603 |
| 5,810,560 | 9/1998 | Tanaka | 416/27 |

FOREIGN PATENT DOCUMENTS 482596 4/1938 United Kingdom .

*Primary Examiner*—Thomas E. Denion
*Assistant Examiner*—Matthew T. Shanley
*Attorney, Agent, or Firm*—Oblon, Spivak, McClelland, Maier & Neustadt, P.C.

[57] ABSTRACT

An engine plant for aircraft comprising a multicylinder internal combustion engine (1) whose crankshaft drives an adjustable pitch propeller (5), mechanisms for adjusting the engine speed and a common power stick (4) that controls the operation of the engine and of the adjustment mechanisms, characterized in that said engine is a compression ignition engine (1) that cooperates with an electronic control system (3) controlling the quantity of the fuel injected.

23 Claims, 3 Drawing Sheets

PROPULSION UNIT FOR AN AIRCRAFT AND ITS CONTROL PROCEDURE

This invention involves an engine plant for aircraft. More particularly, this invention involves an engine plant comprising a multicylinder internal combustion engine with compression ignition whose crankshaft drives an adjustable pitch propeller directly or through the intermediary of transmission mechanisms. This invention also encompasses a control process for the engine plant described herein.

Traditionally, engine plants for aircraft, and more particularly private aircraft, comprise a multicylinder internal combustion engine with controlled ignition having an adjusting diaphragm installed in the air intake that is activated through the intermediary of a power stick. Another stick makes it possible to adjust the quantity of fuel injected and, as a consequence, the richness of the carburized mixture that feeds the combustion chambers in order to take into account variations in the oxygen concentration of the air with altitude.

Just as traditionally, engine plants for aircraft, and more particularly private aircraft, comprise an adjustable pitch propeller driven by the crankshaft of the engine; this propeller is equipped with a centrifugal governor that adjusts the blade angle of the propeller and, as a consequence, the engine load so that the rotation speed of this propeller can be kept constant. This governor is controlled by a specific stick that allows one to modify the rotation speed set-point of the engine.

This traditional architecture of aircraft engine plants, which requires three adjustment sticks to control the internal combustion engine and the adjustable pitch propeller, has numerous disadvantages. Its industrial implementation is complicated and expensive to accomplish. Its control is subtle, particularly for pilots who have little experience, and it is not easy to optimize engine output, i.e., to produce the thrust necessary with fuel consumption that is as reduced as possible.

To eliminate these disadvantages, a new type of engine plant, described in document No. EP-A-322.343, was developed which comprises a single adjustment stick installed in the control console and which controls the engine and the propeller pitch control unit at the same time. The position of the stick is converted into an electrical signal through the intermediary of a repeater potentiometer and transmitted to two separate electronic boxes, an electronic box for controlling the engine (EEC or "electronic engine control") and an electronic box for controlling the speed (SPC or "speed and phase control") that controls the propeller pitch control unit (PCU or "pitch control unit").

This new architecture simplifies the piloting of the airplane and appreciably improves the overall output of the engine plant owing to the use of electronic calculators, but it still remains relatively complex and expensive to manufacture.

The object of the present invention therefore consists in developing an engine plant that is at the same time easy to control, high-performance in terms of output, and simple and economical to produce.

The engine plant for aircraft in accordance with the invention is a type which comprises a multicylinder internal combustion engine whose crankshaft drives an adjustable pitch propeller, means for adjusting the speed of the engine, and a common power stick for controlling the operation of the engine and of the means of adjustment.

In accordance with the invention, the engine plant is characterized in that the engine is a compression ignition engine that cooperates with an electronic control system that controls the quantity of the fuel injected.

In accordance with another feature of the engine plant that is the object of this invention, the means for adjusting the engine speed incorporate the electronic control system, which is designed to adjust the rotation speed of the engine by controlling accordingly the quantity of the fuel injected.

According to another feature of the engine plant that is the object of this invention, as the compression ignition engine is equipped with an in-line injection pump, the electronic control system controls the position of the adjusting spindle of the pump and, through the intermediary of a first adjustment circuit, the rotation speed of the engine; the operation of an actuator that acts on the adjusting spindle of the pump adjusts the fuel delivery rate.

In accordance with another feature of the engine plant that is the object of this invention, the means for adjusting the engine speed comprise mechanisms for adjusting the propeller pitch.

In accordance with another feature of the engine plant covered by this invention, as the adjustable pitch propeller is hydraulically controlled, the adjustment mechanisms for adjusting the propeller pitch comprise a master-controlled solenoid valve allowing adjustment of the quantity of oil in the propeller boss, this solenoid valve being controlled by the electronic control system through the intermediary of a second engine rotation speed adjustment circuit.

In accordance with another feature of the engine plant covered by the invention, to adjust the rotation speed of the engine, the electronic control system acts selectively on the quantity of fuel injected or on the propeller pitch through the intermediary of the first and second engine rotation speed adjustment circuits respectively, using the data supplied by a first position sensor for the power stick, a second position sensor for the adjusting spindle of the injection pump and a third angular position sensor allowing one to determine the engine speed.

In accordance with another feature of the engine plant that is the object of the invention, the position of the adjusting spindle of the injection pump is controlled by the electronic control system according to the position of the power stick and the flight conditions of the aircraft supplied more particularly by external air pressure and temperature sensors.

The invention also involves a control process for such an engine plant. This control process is characterized in that the electronic control system adjusts the engine speed by acting selectively, according to the operating conditions of the engine and of the aircraft, on the quantity of fuel injected or on the pitch of the propeller.

In accordance with another feature of the control process of the engine plant that is the object of the invention, the control system adjusts the rotation speed of the engine by acting on the quantity of the fuel injected into the engine during idling or when the maximum speed of the engine has been reached and, in all the other cases, the control system adjusts the rotation speed of the engine by acting on the pitch of the propeller.

The aims, aspects and advantages of the present invention will be better understood by following the description given hereinafter of a mode of embodiment of the invention, this mode of embodiment being given by way of non-restrictive example, in reference, more particularly, to the appended drawings in which.

Figure 1:
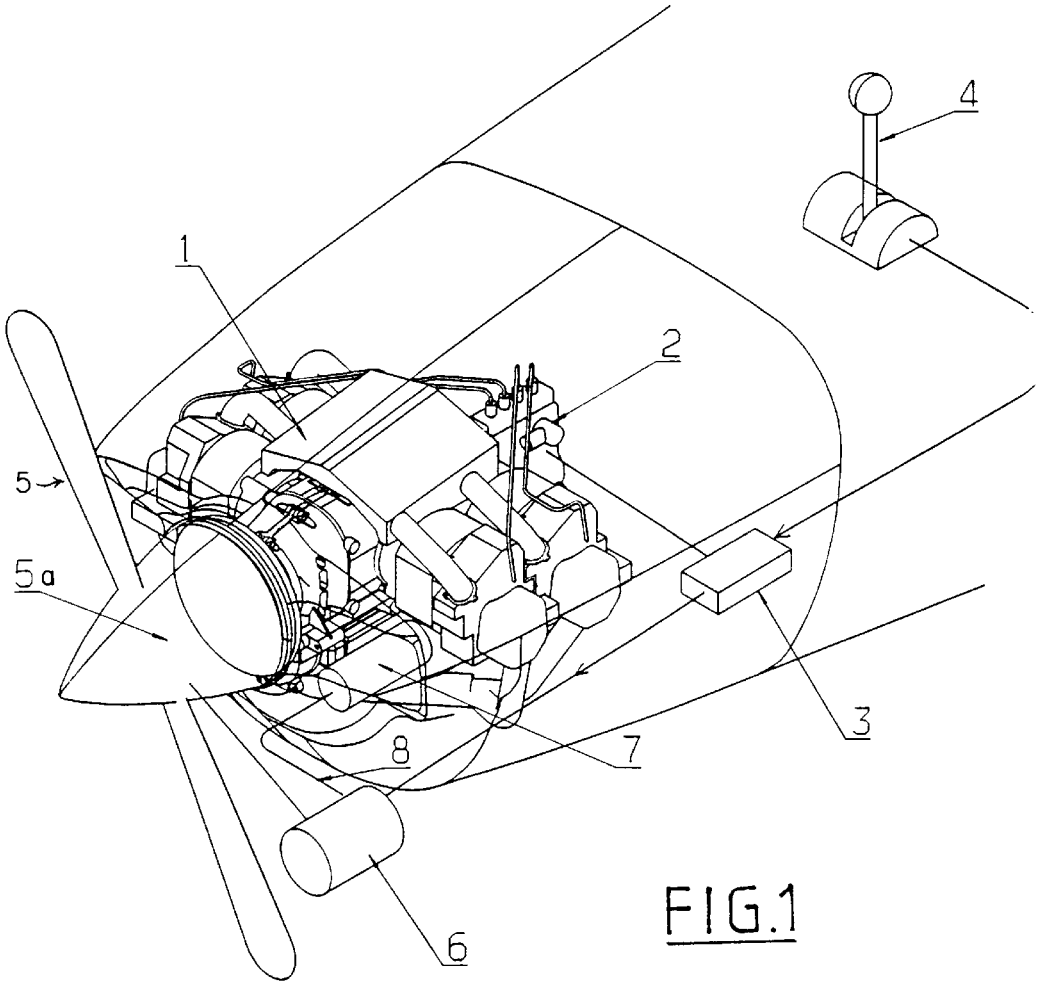
FIG. 1 is a schematic view of the engine plant that is the object of the present invention.

In FIG. 1 one sees, presented in simplified fashion, the configuration of an aircraft engine plant and its electronic control device. Only the component parts that are necessary to an understanding of the invention have been shown.

The engine plant that is shown is designed to drive an airplane, more particularly a private aircraft. This engine plant comprises an internal combustion engine, identified as (1), that drives the adjustable pitch propeller (5) directly or through the intermediary of transmission mechanisms.

The modification of the pitch of the propeller (5) is controlled hydraulically. A feed circuit (8) supplies pressurized oil, delivered by the engine oil pump (7), to the propeller boss (5*a*). A solenoid valve (6) controlled by the electronic control system (3) of the engine plant is installed on this circuit (8); by controlling the quantity of oil sent to the boss, it allows a corresponding adjustment of the pitch of the propeller (5).

In accordance with the invention, the multicylinder engine (1) is a compression ignition engine. This engine (1) is equipped with a standard fuel injection system, namely an in-line injection pump (2) equipped with an electronic adjustment device that adjusts the injection rate according to a mini-maxi strategy explained hereinafter.

The electronic regulator of the injection pump is integrated into the electronic control system (3) of the engine plant. It therefore controls, with automatic follow-up control, an electromagnetic actuator (not shown) that can move the adjusting spindle of the injection pump (2); this adjusting spindle determines the quantity of fuel injected by modifying the stroke of the injection pump pistons.

In known fashion, this electronic control system (3) comprises a microprocessor (CPU), random access memory (RAM), read-only memory (ROM), as well as analog-digital converters (A/D) and various input and output interfaces.

The microprocessor comprises electronic circuits and suitable software for processing the signals coming from adapted sensors (not shown) that supply data concerning the engine operating conditions such as engine speed and the position of the adjusting spindle, as well as data concerning the flight conditions such as the aircraft speed, the external air pressure and temperature, whether the aircraft is in take-off or landing phase, etc.

The microprocessor also receives data in the form of an electrical signal concerning the position of the power stick (4) installed in the aircraft cockpit that controls the engine plant, data that is supplied by a repeater potentiometer (not shown) that is integral with the power stick (4).

From these various data, the microprocessor of the electronic control system implements preset operations in order to generate control signals intended particularly for the electromagnetic actuator that moves the adjusting spindle of the injection pump (2) and the solenoid valve (6) that controls the quantity of oil sent to the propeller boss (5*a*).

Figure 2A:
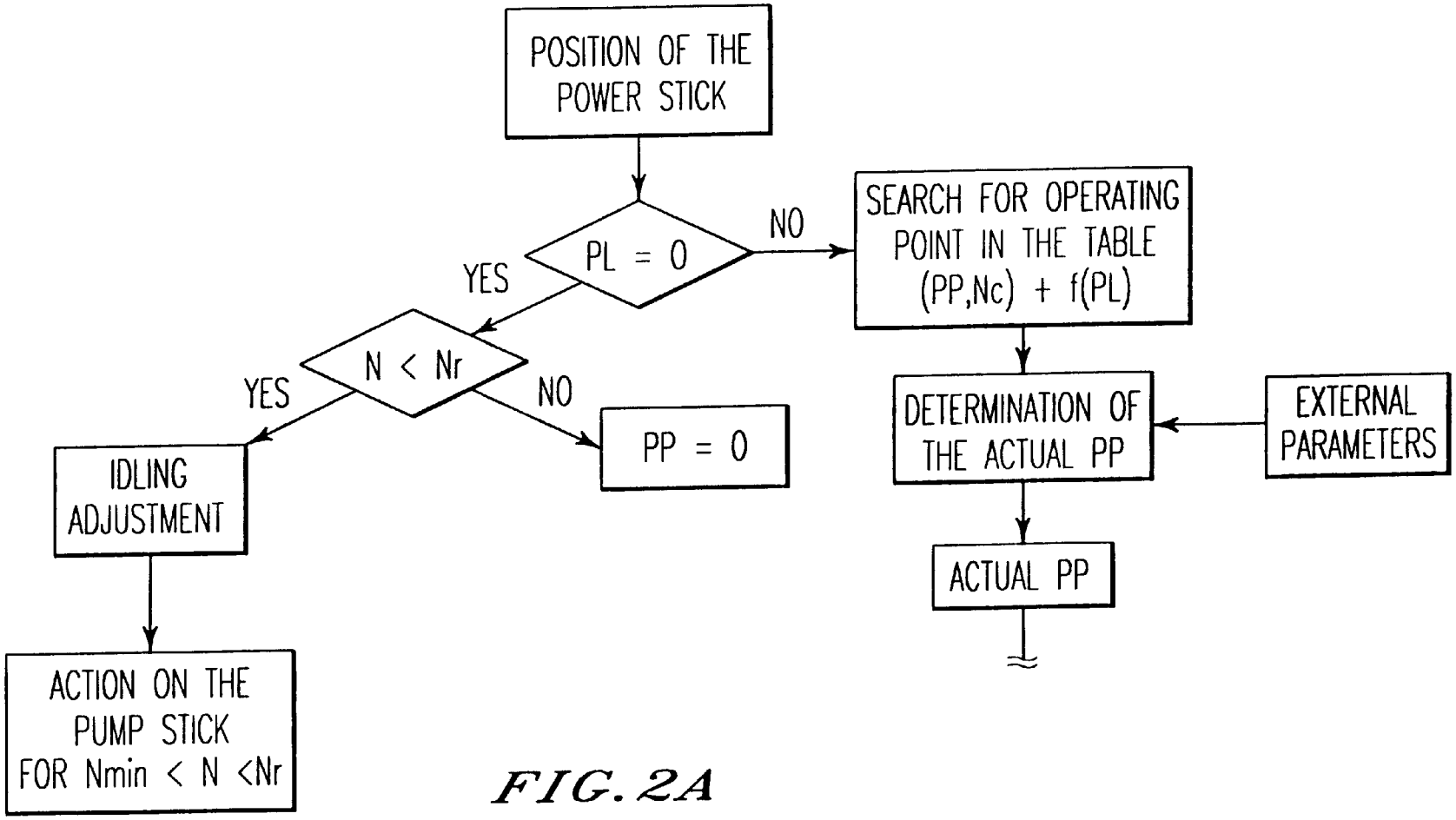
FIG. 2 is a flow chart detailing a control process of the engine plant described in FIG. 1.
Figure 2B:
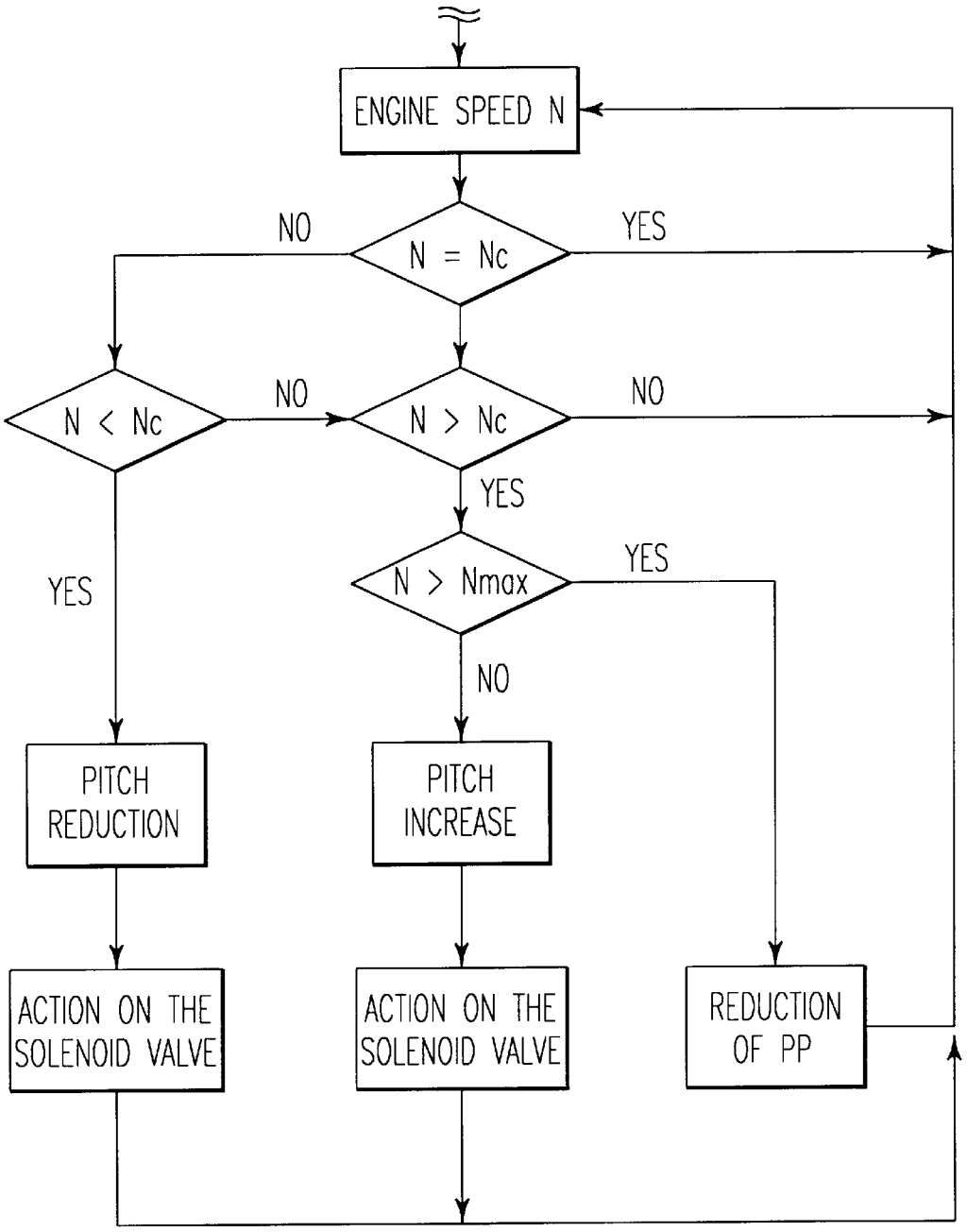

In FIG. 2, a flow chart has been produced to illustrate a control process of the engine plant presented above and, more particularly, the implementation strategy for adjusting the rotation speed of the engine.

The electronic control system (3) adjusts the engine rotation speed either by acting on the quantity of fuel injected or on the pitch of the propeller.

The criteria for implementing either of these adjustments are essentially the position of the power stick (4), PL, the position of the injection pump adjusting spindle (PP), and the rotation speed of the engine, N.

Preset tables stored in the memories of the electronic control system (3), define three distinct ranges of adjustment according to the values of these three criteria.

The first adjustment range is the idling phase of the engine. The adjustment of the rotation speed of the engine is then accomplished solely by action on the adjusting spindle of the injection pump (2); therefore, there is no action on the pitch of the propeller (5).

The adjustment is performed owing to a first pertinent adjustment circuit, for example of the PI type (proportional-integral) or PID (proportional-integral-derived). The position of the adjusting spindle is compared to the determined set-point value by using the stored cartography. The difference between the two values, as well as the difference between the instantaneous speed and the set-point speed constitute the input signals of the adjustment circuit, which then determines the energizing current of the positioning magnet of the electromagnetic actuator.

Recognition of the idling phase is defined by two tests: the position of the power stick (4), which must be at least (PL=0) and the engine rotation speed N, which must be lower than a preset set-point speed Nr. If the position of the power stick (4) is at least (PL=0) and the engine rotation speed N is greater then the threshold value Nr, the electronic control system (3) restricts itself to controlling the position PP of the adjusting spindle of the injection pump (2) to its minimum value.

Once the pilot activates the power stick (4), one leaves the idling phase. Owing to cartography previously stored in its memories, the electronic control system (3) determines the set-point value of the engine rotation speed Nc and the position PP of the adjusting spindle from the position PL of the power stick (4).

The position PP of the adjusting spindle of the injection pump is corrected constantly by the electronic control system (3) by using the flight conditions of the aircraft and, more particularly, the external air pressure and temperature data sent to it by the pertinent sensors.

In this second operating range, the engine rotation speed is adjusted directly through action on the propeller pitch. If the instantaneous speed N becomes greater than Nc, an appropriate increase in the propeller pitch is commanded by acting accordingly on the solenoid valve, and if the instantaneous speed N drops to less than Nc, an appropriate decrease in the propeller pitch is commanded by acting accordingly on the solenoid valve.

The microprocessor of the electronic control system (3) thus has a second adjustment circuit of the PI (proportional-integral) or PID (proportional-integral-derived) type, for example. The difference between the value of the instantaneous speed N and the set-point speed Nc constitutes the input signal of the second adjustment circuit, which then determines the energizing current of the solenoid valve (6).

It must be noted that in the event the power stick (4) is moved from status "1" to status "2," the change from control parameter couple PP1 and Nc1 to couple PP2, Nc2 is accomplished in the following way:

- the adjusting spindle of the injection pump (2) shifts from PP1 to PP2;
- the engine speed shifts from the value Nc1 to an intermediate value;
- the electronic control system (3) then commands the solenoid valve (6) to bring the speed from the value N to the value Nc2, solely by adjusting the pitch of the propeller.

The third adjustment range is defined by any overrun of the maximum rotation speed Nmax authorized for the engine under consideration. In this case, adjustment of the speed to the value Nmax is performed solely by action on the position PP of the adjustment spindle of the injection pump (2) by using the first adjustment circuit, and there is therefore no action on the propeller pitch.

Thus, in accordance with the mode of embodiment described, the adjustment of the rotation speed of the engine is split between the control of the quantity of the fuel injected and the control of the pitch of the propeller while only using a single electronic control system (3). This system therefore integrates two distinct adjustment circuits that are selectively activated according to the operating conditions of the engine and of the aircraft.

The first adjustment circuit controls the injection pump; in the example shown, it is of the mini-maxi type, since it only intervenes during idling and when the maximum speed of the engine has been reached. This type of regulator has the advantage of being extremely simple and sturdy.

The second adjustment circuit controls the pitch of the propeller. This adjustment is performed solely by controlling the solenoid valve (6) installed on the pressurized oil supply circuit (8) of the propeller boss. This type of arrangement eliminates known centrifugal governors, which are heavy and expensive parts. Furthermore, since the control system (3) adjusts the propeller pitch directly based on the engine rotation speed, it is therefore not necessary to have a propeller pitch repeater system Combining the two adjustment circuits in the same electronic control system (3) allows a substantial reduction in the manufacturing cost by simplifying the completion of the control stage of the engine plant by reducing the number of electronic components, sensors and connections.

Combining the two adjustment circuits in the electronic control system (3) also makes it possible to improve engine output.

The Applicant has effectively demonstrated that, depending on the operating conditions of the engine and of the aircraft, the best adjustments possible, at least as such could be determined by appropriate measurement on test benches and then mapped in the memories of the electronic control system (3), involve the adjustment of the rotation speed of the engine through control of either the propeller pitch or the amount of fuel injected.

The use of a compression ignition or diesel engine, independent of the specific performance of this type of engine, notably in terms of fuel consumption, allows one to produce this synergy between the adjustment of the rotation speed achieved by control of the pitch of the propeller and that obtained by control of the amount of fuel injected very simply; this is possible due, more particularly, to the very great simplicity of the electronic devices for adjusting the quantity of fuel presently equipping injection pumps.

Of course, the invention is in no way limited to the mode of embodiment described and illustrated, which has been given strictly by way of example.

On the contrary, the invention comprises all the technical equivalents of the mechanisms described, as well as their combinations, if these are carried out in accordance with its spirit.

Therefore, it is possible to use a "common rail" compression ignition engine in which, in similar fashion to controlled ignition engines, the quantity of fuel injected is determined directly by the opening time of an electro-injector; the injection time is controlled by an injection calculator. This injection calculator would thus be fully integrated into the electronic control system (3).

Therefore, it is possible to use an engine rotation speed adjustment strategy based solely on the quantity of the fuel injected that is slightly more complex than the mini-maxi adjustment described and therefore to introduce new ranges in which the adjustment of the engine rotation speed is performed solely by controlling the quantity of the fuel injected.

We claim:

1. A control system for an aircraft internal combustion engine, comprising:

a first input configured to receive a user defined target engine speed from a power stick;

a first adjustment device configured to adjust a rate of fuel injection into the internal combustion engine;

a second adjustment device configured to adjust a pitch of a propeller of the aircraft;

a second input unit configured to detect an engine rotation rate of the internal combustion engine;

a first electronic circuit configured to signal said first adjustment device to adjust the fuel injection rate according to a predetermined rate corresponding to the target engine speed received from said first input unit, said first electronic circuit configured to compare the detected engine speed with the target engine speed and to signal said second adjustment device to adjust the pitch of the propeller so as to maintain the engine speed at the target engine speed;

a second electronic circuit configured to signal said first adjustment device to adjust the fuel injection rate so as to maintain the engine rotation rate of the engine, and to prevent adjustment of the propeller pitch;

wherein said control system is configured to switch to said first electronic circuit and not said second electronic circuit when the user defined engine rotation rate is within a first range, and wherein said control system is configured to switch to said second electronic circuit, and not said first electronic circuit, when the detected engine rotation rate is within a second range.

2. The control system according to claim 1, wherein said second range includes an engine speed less than or equal to an idle speed of the engine.

3. The control system according to claim 2, wherein said second range further includes an engine speed greater than or equal to a maximum prescribed rotation rate for the engine.

4. The control system according to claim 3, wherein said first range includes an engine speed greater than an idle speed of the engine.

5. The control system according to claim 1, wherein said first range includes an engine speed greater than an idle speed of the engine.

6. The control system according to claim 1, wherein said first adjustment device is configured to adjust the fuel injection delivery rate and air fuel proportion of a fuel injected into the internal combustion engine.

7. The control system according to claim 6, wherein the internal combustion engine is a compression ignition engine equipped with an in line fuel injection pump, wherein said first adjustment device is configured to adjust a position of an adjusting spindle of the in line fuel injection pump which thereby adjusts the rate of fuel injected into said internal combustion engine.

8. The control system according to claim 7, wherein the aircraft includes an adjustable pitch propeller that is hydraulically operated, and wherein said second adjustment device comprises a solenoid valve configured to control the amount of oil in a propeller boss of the adjustable pitch propeller.

9. The control system according to claim 8, further comprising an external air pressure detector and a temperature detector connected with the second circuit, and wherein said second circuit determines a fuel injection rate according to the target engine speed and at least one of an external air pressure detected by said external air pressure detector and an external temperature detected by said temperature detected.

10. A control system for an aircraft internal combustion engine, comprising:

a first input means for receiving a user defined target engine speed from a power stick;

a first adjustment means for adjusting a rate of fuel injection into the internal combustion engine;

a second adjustment means for adjusting a pitch of a propeller of the aircraft;

a second input means for detecting an engine rotation rate of the internal combustion engine;

a first engine control means for signaling said first adjustment means to adjust the fuel injection rate according to a predetermined rate corresponding to the target engine speed received from said first input means, said first engine control means for comparing the detected engine speed with the target engine speed and to signal said second adjustment means to adjust the pitch of the propeller so as to maintain the engine speed at the target engine speed;

a second engine control means for signaling said first adjustment means to adjust the fuel injection rate so as to maintain the engine rotation rate of the engine, and for preventing adjustment of the propeller pitch;

wherein said control system includes means for energizing said first engine control means and not said second control means, when the target engine rotation rate is within a first range, and wherein said control system includes means for energizing said second engine control means, and not said first engine control means, when the detected engine rotation rate is within a second range.

11. The control system according to claim 10, wherein said second range includes an engine speed less than or equal to an idle speed of the engine.

12. The control system according to claim 11, wherein said second range further includes an engine speed greater than or equal to a maximum prescribed rotation rate for the engine.

13. The control system according to claim 12, wherein said first range includes an engine speed greater than an idle speed of the engine.

14. The control system according to claim 10, wherein said first range includes an engine speed greater than an idle speed of the engine.

15. The control system according to claim 10, wherein said first adjustment means includes means for adjusting the fuel injection delivery rate and air fuel proportion of a fuel injected into the internal combustion engine.

16. The control system according to claim 15, wherein the internal combustion engine is a compression ignition engine equipped with an in line fuel injection pump, wherein said first adjustment means includes means for adjusting a position of an adjusting spindle of the in line fuel injection pump which thereby adjusts the rate of fuel injected into said internal combustion engine.

17. The control system according to claim 16, wherein the aircraft includes an adjustable pitch propeller that is hydraulically operated, and wherein said second adjustment means includes a solenoid valve for controlling the amount of oil in a propeller boss of the adjustable pitch propeller.

18. The control system according to claim 17, further comprising an external air pressure detector means and a temperature detector means connected with the second engine control means, and wherein said second engine control means includes means for determining a fuel injection rate according to the target engine speed and at least one of an external air pressure detected by said external air pressure detector means and an external temperature detected by said temperature detector means.

19. A method for controlling an internal combustion engine of an aircraft, comprising the steps of:

detecting a user-defined target engine speed;

detecting an actual rotation speed of the internal combustion engine;

adjusting a fuel injection rate into the internal combustion engine to maintain a user-defined target engine rotation rate, when the user-defined target engine rotation rate is within a first range;

adjusting a fuel injection delivery rate according to a predetermined rate corresponding to the detected engine rotation rate, and adjusting a pitch of a propeller of the aircraft in order to maintain the detected engine rotation rate at the user-defined target rotation rate, when the user-defined target engine rotation rate is within a second range.

20. The method according to claim 19, wherein the second range includes an engine speed less than or equal to an idle speed of the engine.

21. The control system according to claim 20, wherein the second range further includes an engine speed greater than or equal to a maximum prescribed rotation rate for the engine.

22. The control system according to claim 21, wherein the first range includes an engine speed greater than an idle speed of the engine.

23. The control system according to claim 19, wherein said first range includes an engine speed greater than an idle speed of the engine.

* * * * *